United States Patent [19]

Pease et al.

[11] 4,068,487

[45] Jan. 17, 1978

[54] METHOD AND APPARATUS FOR CONDUCTING SUBAQUEOUS OPERATIONS IN ICE CONDITIONS

[75] Inventors: Floyd Tim Pease, Houston; Gerhard Helmut Reusswig, Conroe; Porter Russell Edling, Houston, all of Tex.

[73] Assignee: The Offshore Company, Houston, Tex.

[21] Appl. No.: 682,187

[22] Filed: Apr. 30, 1976

[51] Int. Cl.[2] ..... E02B 17/00; E21B 15/00

[52] U.S. Cl. ..... 61/93; 61/103; 104/35; 105/163 R; 175/7

[58] Field of Search ..... 61/86, 93, 103; 175/7, 175/8, 9; 104/35, 98, 175; 105/163, 29 R; 114/264, 265; 9/8

[56] References Cited

U.S. PATENT DOCUMENTS

| | | | |
|---|---|---|---|
| 516,032 | 3/1894 | Symonds | 175/9 |
| 673,622 | 5/1901 | Moore | 105/163 R |
| 1,128,039 | 2/1915 | Piercy | 61/93 |
| 3,033,525 | 5/1962 | Johnson | 61/93 X |
| 3,171,363 | 3/1965 | Eden et al. | 105/29 R |

*Primary Examiner*—Jacob Shapiro
*Attorney, Agent, or Firm*—Vinson & Elkins

[57] ABSTRACT

An improved platform for performing subaqueous operations in ice conditions. A substructure on the platform supports the equipment for performing the subaqueous operation and straddles an aperture through the platform. Means are secured to the underside of the substructure for presenting a relatively low coefficient of friction or low lateral resistance between the underside of the substructure and the face of the platform. Locomotion means are associated with substructure for moving the substructure laterally over the face of the platform relative to the aperture whereby the equipment for performing the subaqueous operations may remain over the wellhead in spite of certain magnitudes of lateral movement of the platform responsive to the ice conditions.

3 Claims, 16 Drawing Figures

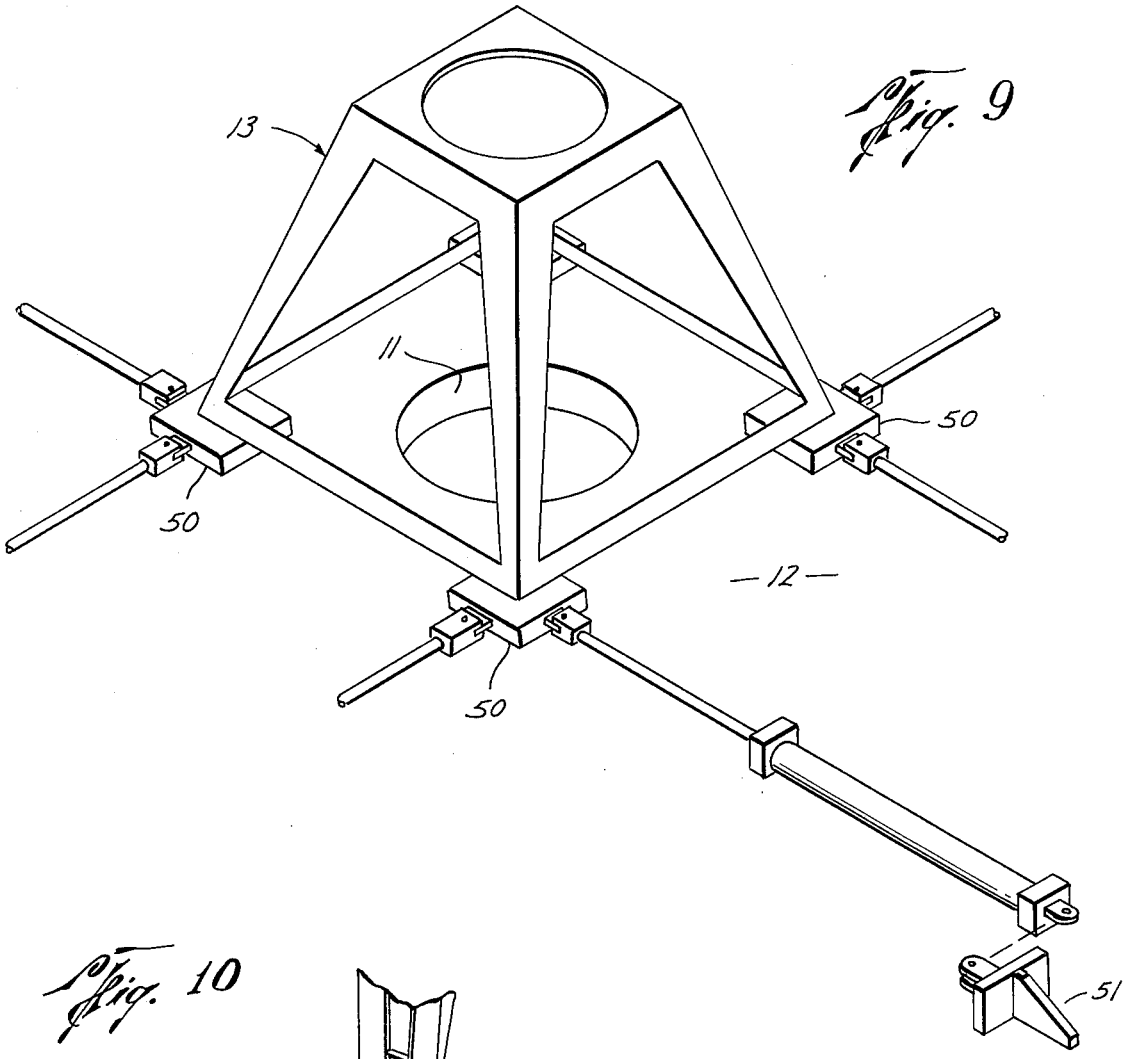
Fig. 9
Fig. 10
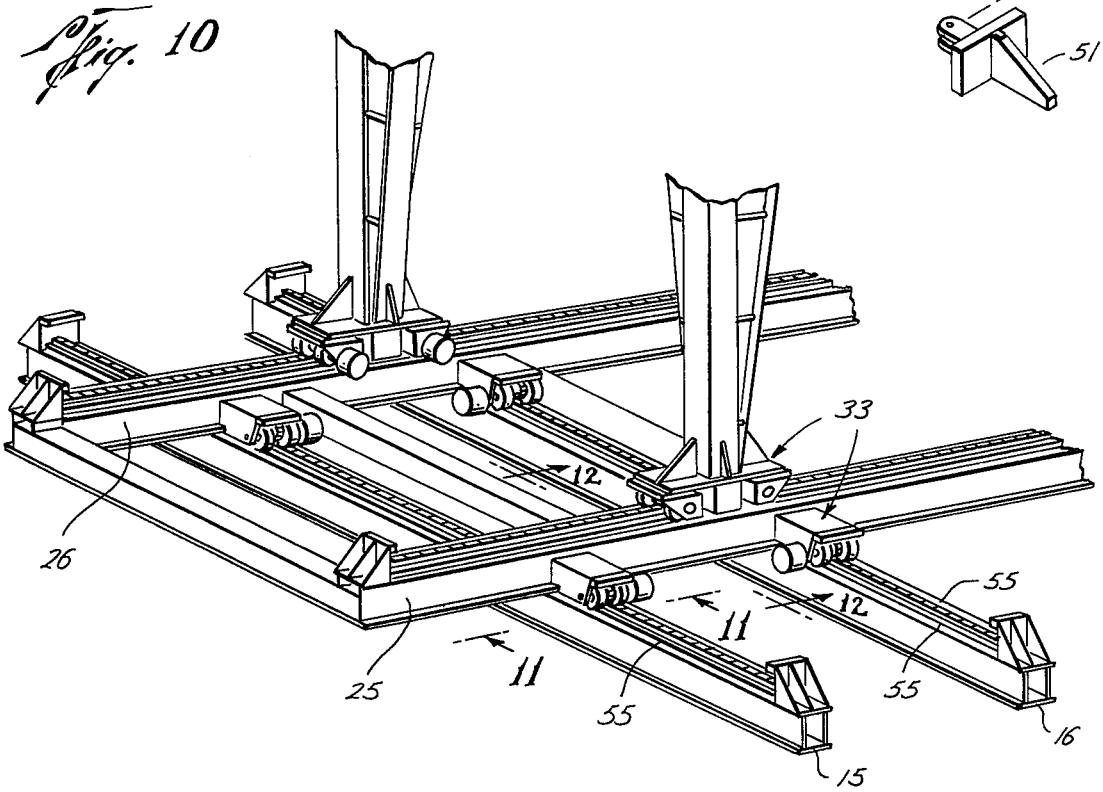

METHOD AND APPARATUS FOR CONDUCTING SUBAQUEOUS OPERATIONS IN ICE CONDITIONS

BACKGROUND AND OBJECTS OF THE INVENTION

This invention relates to an improved substructure for use on a platform for performing subaqueous operations in ice conditions, wherein the equipment for performing the subaqueous operations may be easily and efficiently moved relative to the platform and, within certain limits, thereby be maintained in a selected horizontal position relative to the seabed.

It is desirable that a platform utilized for performing subaqueous operations in semi-frozen waters may withstand the forces of moving ice and not be moved from its selected horizontal position relative to the seabed. However, due to the enormous forces produced by ice movement, it is extremely difficult to construct a platform which will withstand such forces of ice movement. It is therefore desirable to provide an improved platform in which the equipment for performing the subaqueous operations can move relative to the platform a selected amount to counteract the ice movement and thus the equipment will remain in a selected horizontal position relative to the seabed.

It is an object of this invention to provide an improved platform for supporting equipment for performing subaqueous operations in ice conditions wherein the equipment may be moved relative to the platform to allow some horizontal movement of the platform responsive to the forces of the ice without endangering the subaqueous operations and so that more time is provided for safe abandonment procedures and for counteracting ice movement with cutters or other devices.

It is an object of this invention to provide an improved platform for supporting equipment for performing subaqueous operations wherein the equipment may move horizontally relative to the platform such that the platform has the ability to continue the subaqueous operations during cyclic ice movement occurring from thermal expansion and contraction.

This invention possesses many other advantages and has other objects which will be apparent from the embodiments of the invention shown in the drawings accompanying and forming part of the present specification. These embodiments of the invention will not be described in detail for the purpose of illustrating the principles of the invention.

BRIEF DESCRIPTION OF THE DRAWINGS

FIG. 9 is an isometric view of another preferred means for presenting relatively low lateral resistance between the substructure and the platform and another preferred locomotion means for moving the substructure laterally over the face of the platform according to this invention.

FIG. 10 is a isometric view of still another preferred means for presenting relatively low lateral resistance between the substructure and the platform and another preferred locomotion means for moving the platform laterally over the face of the platform according to this invention.

DESCRIPTION OF THE INVENTION

Figure 1:
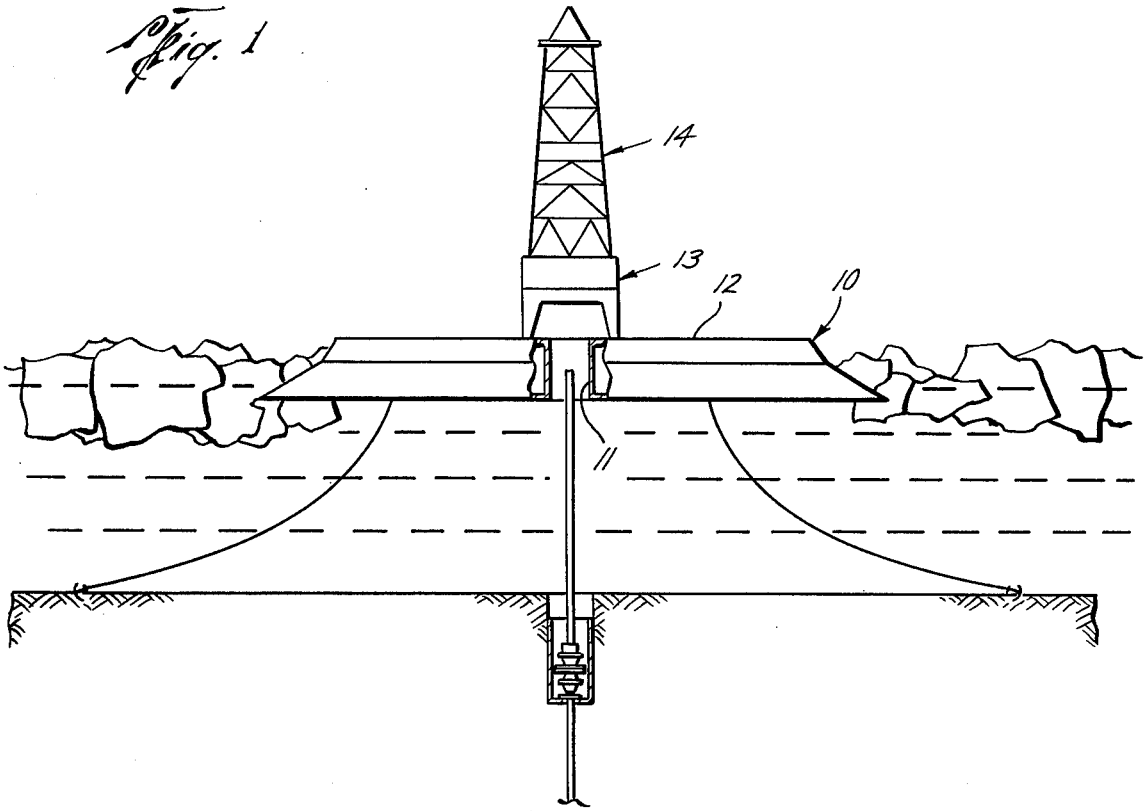
FIG. 1 is an elevation view of an improved platform according to this invention floating an ice-covered water an anchored in place above a wellhead.
Figure 2:
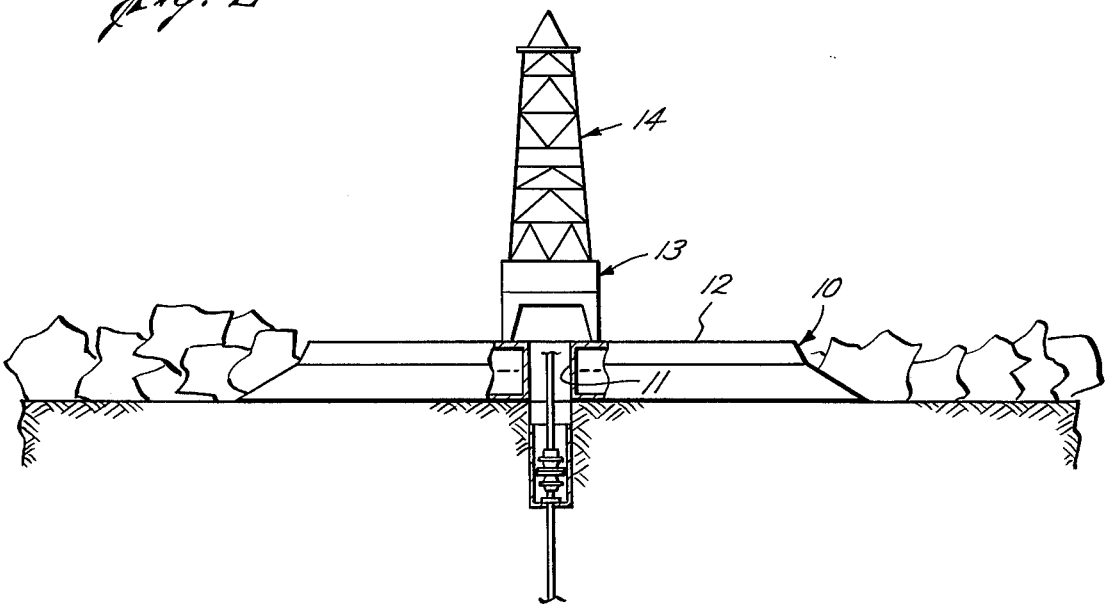
FIG. 2 is an elevation view of an improved platform according to this invention resting on the seabed above the wellhead in shallow water covered by ice.

FIGS. 1 and 2 illustrate a preferred platform from which subaqueous operations are performed in ice conditions. The preferred platform preferrably includes a bouyant hull 10 having an aperture 11 therethrough. Mounted on the face 12 of the platform and straddling the aperture 11 is a substructure 13. The substructure 13 preferably is an open, rectangularly-shaped apparatus which supports the equipment 14, such as the derrick and the like, for performing the subaqueous operation. The equipment 14 extends downwardly through the aperture 11 into the sea bed. FIG. 1 illustrates the equipment 14 as comprising a derrick supporting a drill string extending downwardly and penetrating the subsea soil at the well head.

In deep water operating conditions, the platform may be anchored into position over the well head as illustrated in FIG. 1. Preferably the hull 10 comprises a continuous fabricated steel and/or reinforced concrete apparatus having ballastable and deballastable compartments (not shown) so that in shallow water operations the hull may be deballasted until it rests on the sea bottom as illustrated in FIG. 2. To prevent freezing of the ballast water, preferably a combination of active sea water circulation, insulation and heating is utilized.

The hull form preferably is that of an upright, rectangular frustum which produces an upward and inward sloping entry around the girth of the hull. The entry angle of the hull causes moving ice to ride up on the incline and be fractured in its upward bending.

Secured between the underside of the substructure 13 and the face of the platform is a means for presenting a low coefficient of friction between the substructure and the face of the platform. Associated with the substructure is a locomotion means for moving the substructure laterally over the face of the platform relative to the aperture 11 whereby the equipment 14 may remain centered over the wellhead in spite of certain magnitudes of lateral movement of the platform responsive to the ice conditions.

Figure 3:
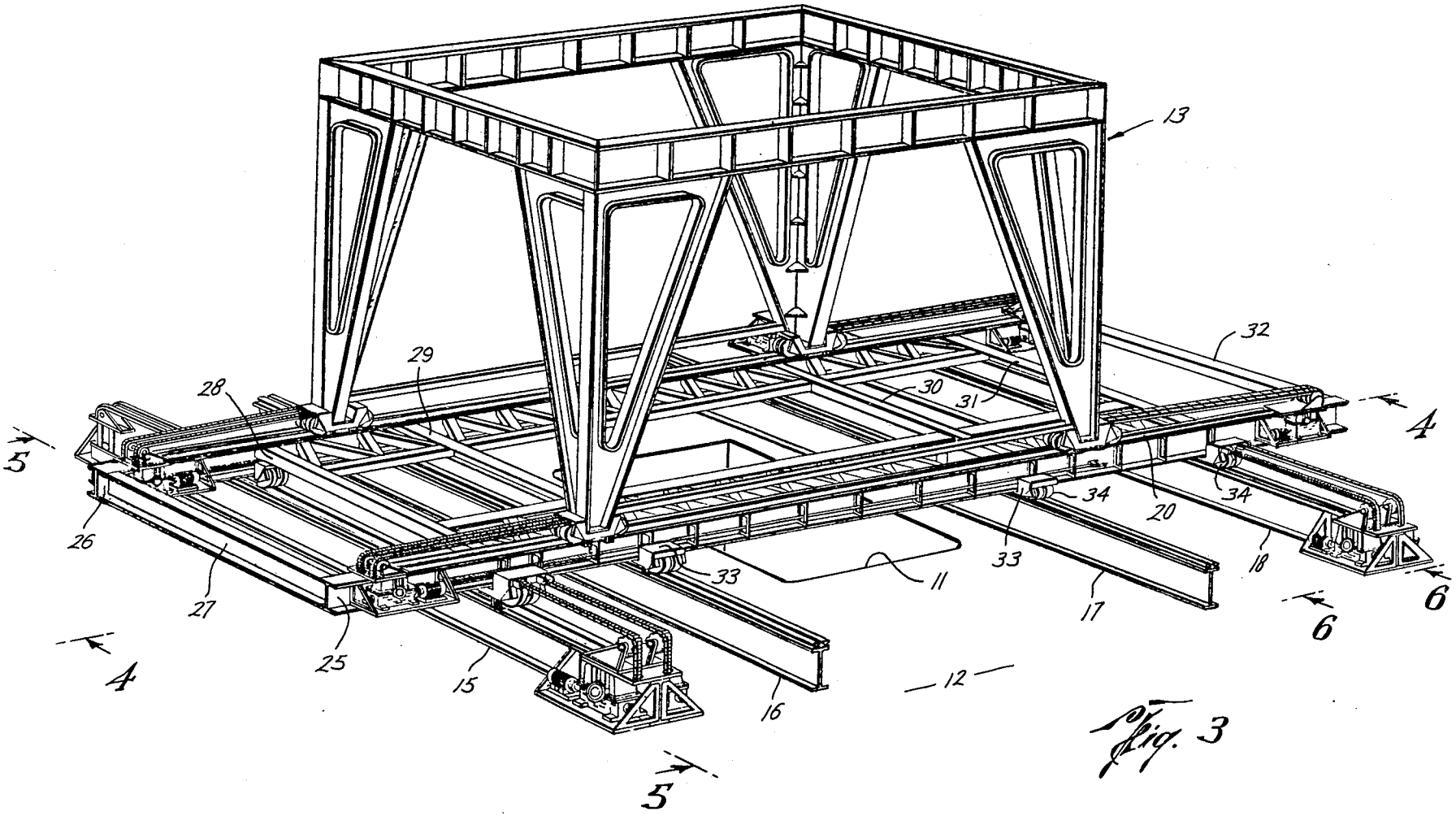
FIG. 3 is an isometric view of a preferred means for presenting relatively low lateral resistance between the substructure and the platform and a preferred locomotion means for moving the substructure laterally over the face of the platform according to this invention.

FIGS. 3–8 illustrate a preferred embodiment of the means for presenting a low coefficient of friction and the locomotion means according to this invention. Referring particularly to FIG. 3, the substructure 13 is shown positioned over the aperture 11 so that it straddles the aperture 11. Associated with the substructure 13 and the face 12 of the platform are lower skid beams 15, 16, 17 and 18 secured to the face 12 of the hull 10 parallel to each other in pairs on either side of the aperture 11. As shown particularly in FIGS. 4 and 4A, each of the skid beams 15, 16, 17 and 18 preferably is an I-beam, or similar structural element, with dual rails 20 secured longitudinally along its length on the top thereof. The rails 20 are standard crane rails or the like.

Figures 4, 4A:
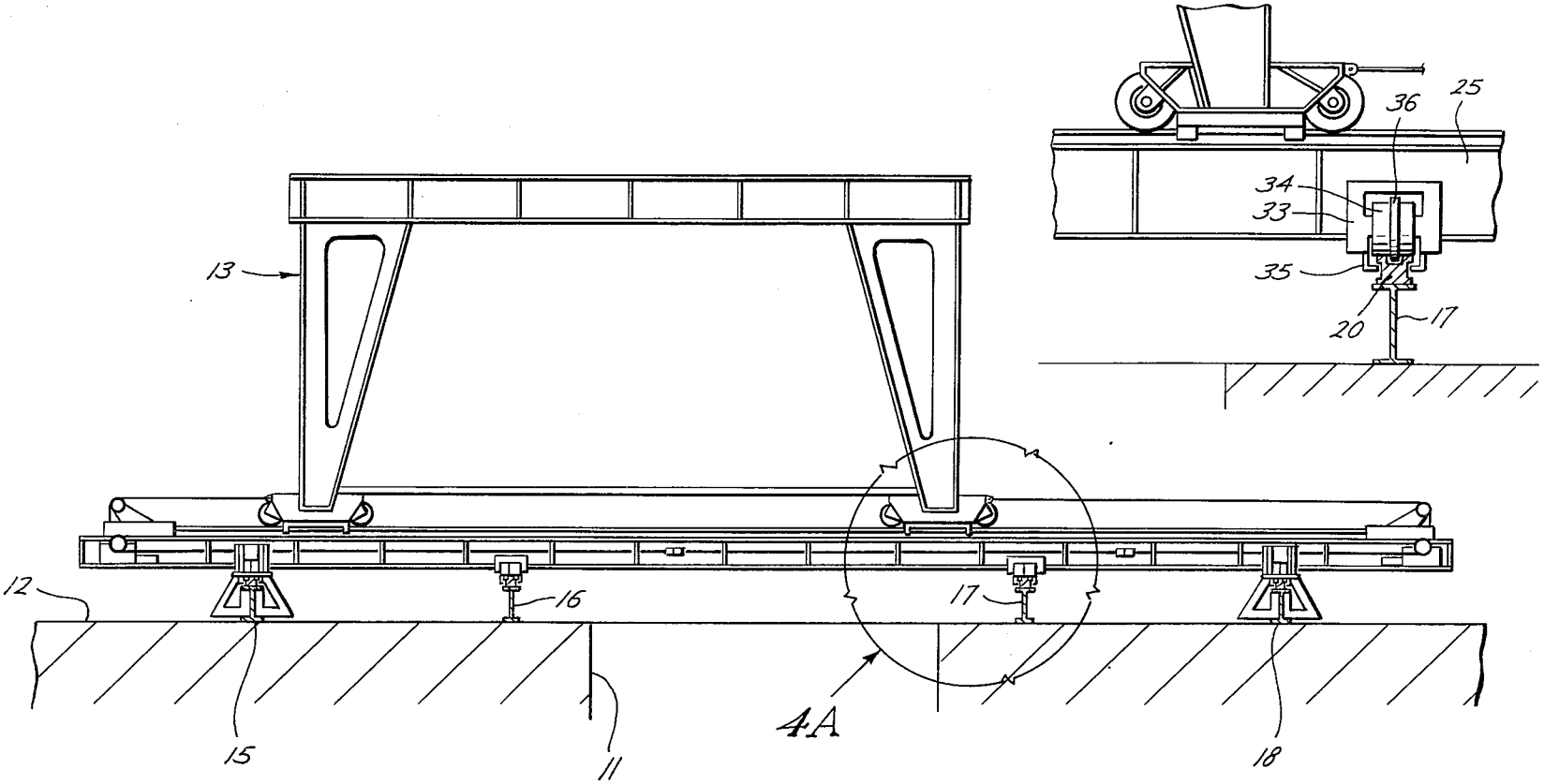
FIG. 4 is an enlarged elevation view of the portion of the means for presenting relatively low lateral resistance to the movement of the substructure the locomotion means taken at line 4—4 in FIG. 3.
FIG. 4A is a detail view of the portion of the apparatus shown in the circle 4A in FIG. 4.
Figures 5, 5A:
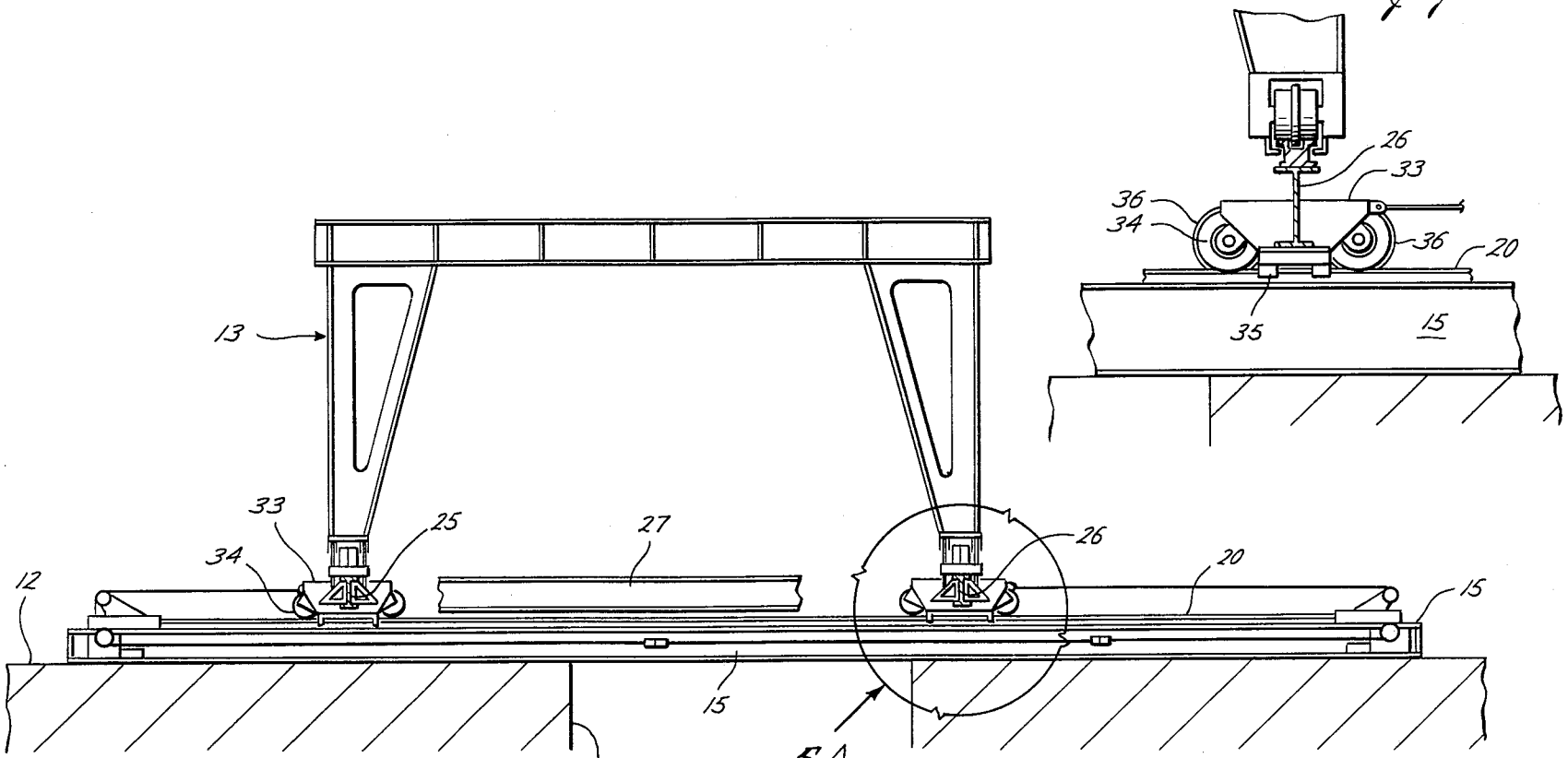
FIG. 5 is an enlarged elevation view of the portion of the means for presenting relatively low lateral resistance and the locomotion means taken at line 5—5 in FIG. 3.
FIG. 5A is a detail view of the portion of the apparatus shown in circle 5A in FIG. 5.
Figure 6:
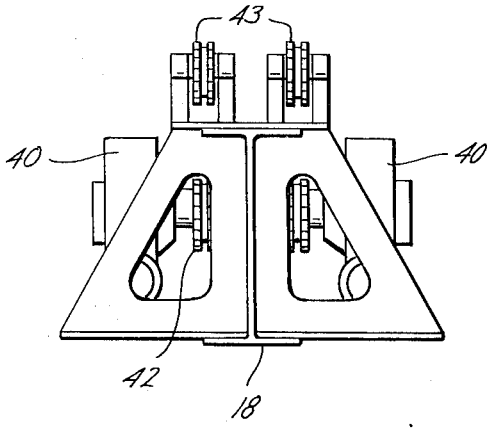
FIG. 6 is an end view of the lower skid beam and the substructure motor, chain and drive sprocket taken at line 6—6 in FIG. 3.
Figure 7:
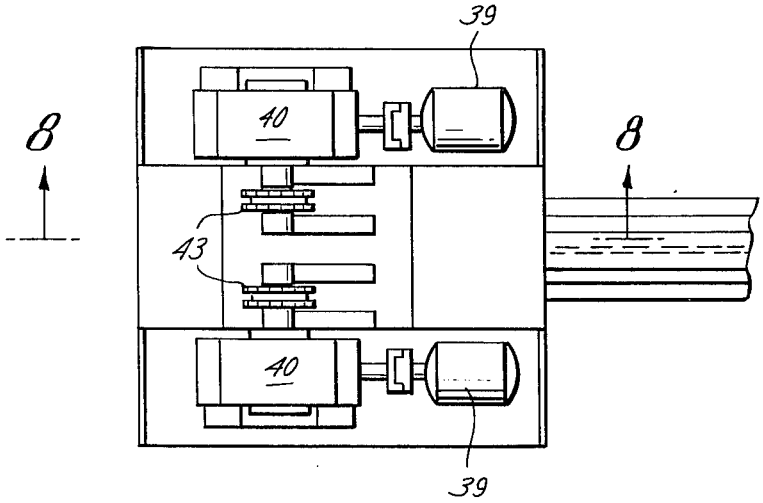
FIG. 7 is a top view of the lower skid beam and the substructure motor, chain and drive sprocket shown in FIG. 6.
Figure 8:
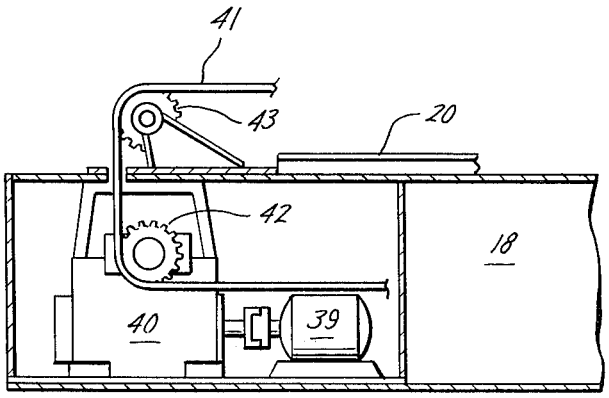
FIG. 8 is a side view of the lower skid beam and the substructure motor, chain and drive sprocket taken at line 8—8 in FIG. 7.

Referring again to FIG. 3, two horizontal upper skid beams 25 and 26 are positioned atop the rails 20 perpendicular to the lower skid beams. The two upper skid beams 25 and 26 are positioned such that they are spaced apart from each other and straddle the aperture 11. The upper skid beams 25 and 26 are interconnected with each other by horizontal spacing beams 27, 28, 29, 30, 31 and 32 whereby their movement longitudinally along the lower skid beams will be coordinated together. Mounted beneath each end of the spacing beams 28, 29, 30 and 31 is a travelling member 33 which carries two sets of rollers 34. Referring particularly to FIGS. 4 and 4A, each of the travelling members preferably includes a pair of downwardly and inwardly extending flanges 35. These flanges 35 communicate with the outer sides of the rails 20 mounted atop the lower skid beams. Each of the rollers 34 preferably includes a guide flange 36 which communicates with the inner side of the adjacent rail 20. The flanges 35 and the flanges 36 allow guided lateral movement of the interconnected upper skid beams along the longitudinal length of the lower skid beams.

Each of the upper skid beams 25 and 26 also preferably is an I-beam which has dual rails 20 secured to the top thereof along its length. As illustrated in FIG. 3, each of the four legs of the substructure 13 preferably has a travelling member 33 mounted beneath it, which travelling member 33 includes two sets of rollers 34 and guide flanges 35 for communicating with the rails 20.

In the embodiment of the invention illustrated in FIG. 3, the means for presenting a low coefficient of friction between the substructure and the face of the platform comprise the travelling members secured to the substructure, the upper skid beams, the travelling members secured to the upper skid beams, and the lower skid beams.

In the embodiment of the invention illustrated in FIG. 3, the locomotion means for effecting movement of the substructure 13 laterally and longitudinally of the aperture 11 includes means for imparting force to the substructure 13 to move it longitudinally along the upper skid beams and means for imparting force to the upper skid beams to move them along the lower skid beams. Preferably, these force imparting means include a pair of motors 39 and a pair of speed converters 40 associated with each end of each of the lower skid beams 15 and 18. As illustrated particularly in FIGS. 3, 6, 7 and 8, a drive motor 309 is secured an either side of the lower skid beam adjacent its end. Each drive motor 39 is operably connected to a speed converter 40 which is also located adjacent the end of the lower skid beam. A drive sprocket 42 is secured to the output shaft of each of the speed converters 40 and a guide sprocket 43 secured to the top of the lower skid beam 18 is associated with such guide sprocket 43. Two drive chains 41 or the equivalent thereof are secured to the travelling member 33 associated with the particular end of the lower skid beam, are passed over the two guide sprockets 43 and around the two drive sprockets 42 associated with the two speed converters 40 positioned at the end of the lower skid beam, are passed along the length of the skid beam in the channel thereof to its opposite end, are passed around the guide sprockets 43 and the guide sprockets 42 of the other speed converters 40 associated with the other end of the lower skid beam, and are secured to the travelling member 33 associated with the other end of the lower skid beam.

The locomotion means also preferably includes similar pairs of skid beam motors 39, speed converters 40, drive sprockets 42 and guide sprockets 43 mounted at each end of the upper skid beams 25 and 26. Drive chains 41 are secured from the travelling member attached to the substructure and associated with one end of the upper skid beam, are passed around the drive sprockets and guide sprockets associated with the speed converter at the end of the upper skid beam, are passed along the longitudinal length of the upper skid beam in the channel thereof to the other end, are passed around the drive sprockets and guide sprockets associated with the speed converters at the other end of the upper skid beam, and are secured to the other travelling member associated with the upper skid beam.

The drive motors preferably are standard commercial electrical motors of suitable rating for a more readily flexible connection to the power source on the platform; however, the drive motors could also be hydraulic.

In operation, as the platform is moved about horizontally over the well head by the forces of the ice, such as by the thermal expansion and contraction of the ice, the operators of the vessel selectively activate the locomotion means to supply force to the substructure to move the substructure horizontally over the face of the platform relative to the aperture. Particularly, the operators on the platform energize the lower skid beam motors mounted at a selected end of the lower skid beams to supply force to the upper skid beams wherein the upper skid beam assembly is moved laterally along the longitudinal length of the lower skid beams until the upper skid beam assembly and the substructure carried thereby is positioned in desired relationship to the aperture 11. The operator of the system then energizes the upper skid beam motors 39 mounted at a selected end of the upper skid beams so that force is supplied to the substructure 13 to move the substructure 13 toward such motors until the substructure 13 is positioned in a selected relationship to the aperture 11. When the substructure 13 is positioned in the desired relationship to the aperture 11, the substructure 13 and the upper skid beams are securely tied down to the face of the platform as is conventionally performed by those skilled in the art.

In an alternative form of the invention, rather than rollers being secured to the underside of the legs of the substructure and the undersides of the upper skid beams, the underside of the legs of the substructure and the underside of the upper skid beams could be fitted with low friction bearing surfaces comprised of TEFLON composites and other materials commercially available for this type of highload, low speed movement, or air bearings could be utilized between the substructure and the upper skid beam and between the upper skid beams and the lower skid beams.

In an alternative embodiment of the invention illustrated in FIG. 9, the substructure 13 is positioned directly on the face of the platform. The below-deck structure of the face of the platform is suitably reinforced (not shown) to support the localized loading from the substructure 13. Secured to the underside of the substructure are means for presenting a low coefficient of friction between the underside of the substructure and the hull. The means for presenting a low coefficient of friction preferably comprise a large metallic plate 50 or pad located at each of the apexes of the underside of the substructure, each plate having a TEFLON surface on its underside. However, each plate could carry on its underside ball-bearings or other devices presenting a low coefficient of friction between the underside of the substructure and the vessel.

A plurality of anchors 51 are secured to the vessel at selected locations spaced from the substructure 13 and the aperture straddled by the substructure. In this alternative embodiment of the invention illustrated in FIG. 9, there are eight anchors employed, two of such anchors being employed adjacent each side of the rectangularly-shaped substructure 13. Locomotion means are connected between each of the anchors and the substructure 13 for supply force to the substructure for moving the substructure horizontally over the face of the vessel relative to the aperture. In the alternative embodiment of the invention illustrated in FIG. 9, each of the locomotion means preferably is an expansible and contractible mechanism, such as a hydraulic piston and cylinder assembly. However, the force means may comprise other suitable types of apparatus, such as winches and cables connected between the anchors and the substructure 13 or the means for presenting a low coefficient of friction to the face of the hull.

When a piston and cylinder assembly is utilized, the piston and cylinder assembly preferably is pivotally connected between the anchor and the substructure 13 or the means for presenting a low coefficient of friction between the underside of the substructure and the vessel. In the embodiment of the invention illustrated in FIG. 9, each piston and cylinder assembly is pivotally connected between an anchor 51 and a plate 50 or pad for presenting a low coefficient of friction to the surface of the vessel.

As illustrated in FIG. 9, if the underside of the substructure 13 is rectangularly shaped, it is preferred that each apex of the rectangularly-shaped underside of the substructure have two force means associated therewith, one applying force in the general direction analogous to the abscissa and the other applying force in the general direction analogous to the ordinate.

In the operation of the alternate embodiment of the invention illustrated in FIG. 9, as the platform is moved about horizontally over the well head by the forces of the ice, such as by the normal expansion and contraction of the ice, the operators of the vessel selectively activate the locomotion means to supply force to the substructure to move the substructure laterally over the face of the platform relative to the aperture. This causes the equipment carried by the substructure to move relative to the platform and to remain in a desired horizontal position above the well head.

Figure 11:
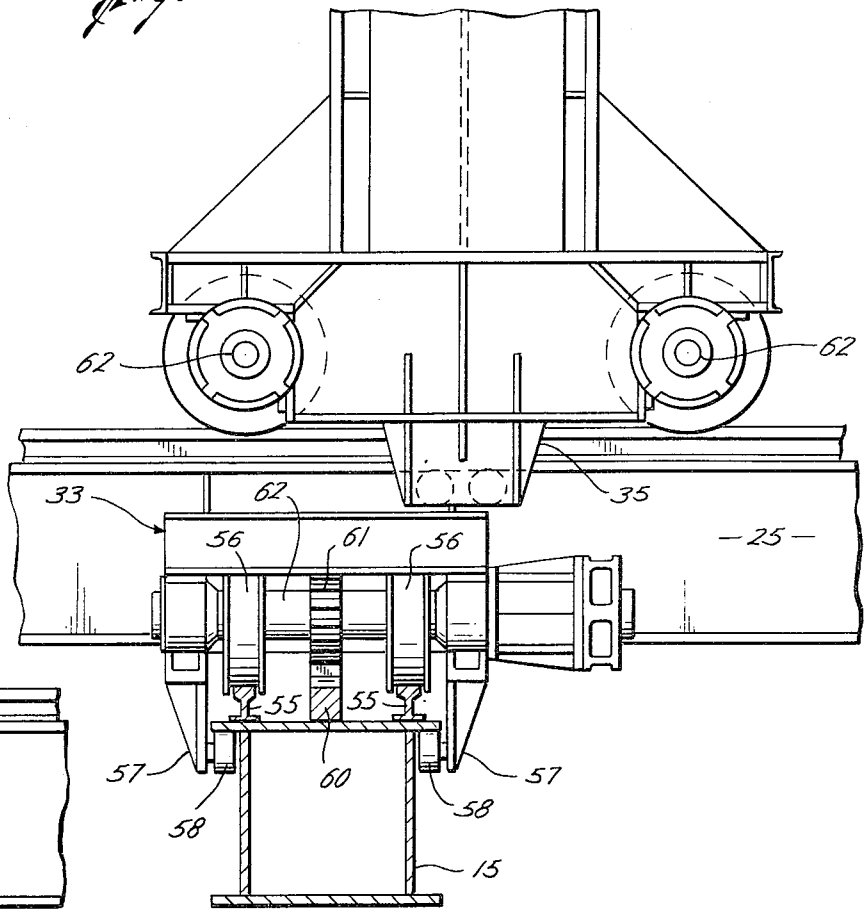
FIG. 11 is an enlarged elevation view of the portion of the means for presenting a relatively low lateral resistance and the locomotion means taken at line 11—11 in FIG. 10.
Figure 12:
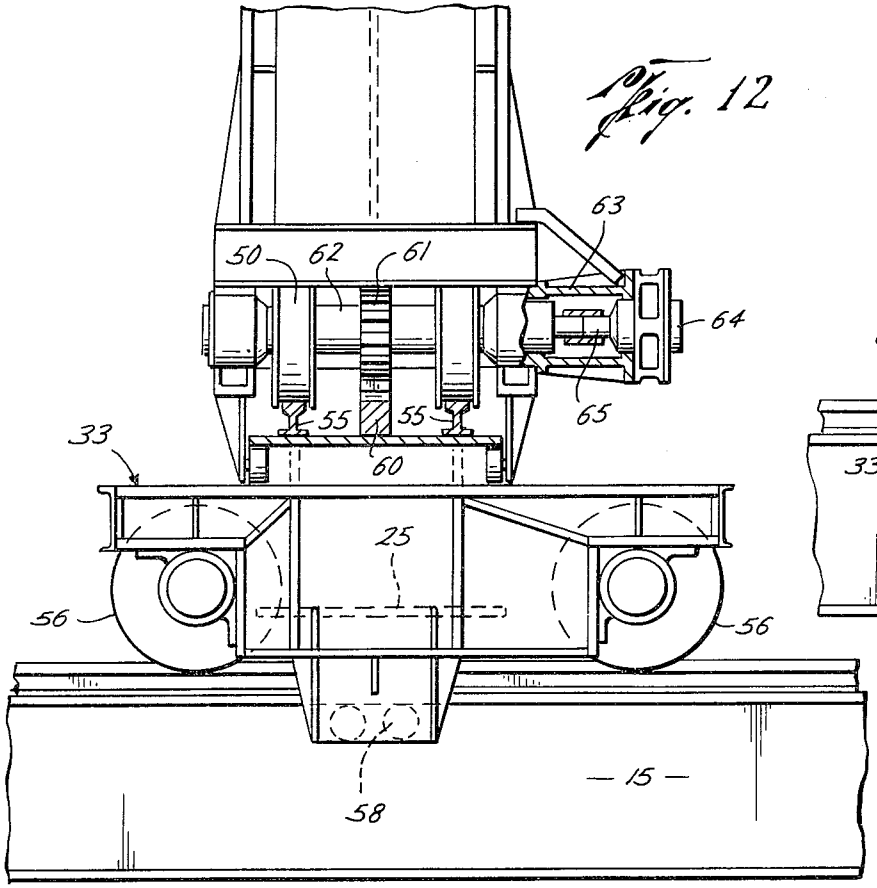
FIG. 12 is an enlarged view of a portion of the means for presenting relatively low lateral resistance and the locomotion menas taken at line 12—12 in FIG. 10.

FIGS. 10 and 11 and 12 illustrate another alternative platform from which subacqueous operations may be performed in ice conditions. This alternative embodiment of the invention utilizes lower skid beam 15, 16, 17 and 18, similar to those described with respect to FIG. 3, which are positioned in pairs parallel to each other on either side of the aperture 11. Each of the lower skid beams 15, 16, 17 and 18 has a pair of mounting frames or carriage rails 55 secured to the top thereof along its longitudinal length. Upper skid beams 25 and 26, similar to those described with respect to FIG. 3, are positioned atop the lower skid beams perpendicular thereto on either side of the aperture 11. Each of the upper skid beams 25 and 26 has a travelling member 33 secured beneath it at the location where such upper skid beam crosses each of the lower skid beams 15, 16, 17 and 18. Each travelling member 33 carries two pairs of wheels 56, each wheel being mounted for movement longitudinally along the upper surface of the associated carriage rail 55 secured to the top of the lower skid beam. Each travelling member 33 also includes a pair of downwardly extending flanges 57 which communicate with the recessed area of the lower skid beam by means of roller bearing assemblies 58.

Similarly, each of the upper skid beams 25 and 26 carries a pair of mounting frames or carriage rails 55. The substructure 13 carries a travelling member 33 on the underside of each apex, each travelling member including a pair of wheels 56, each wheel communicating with the associated carriage rail for longitudinal movement along the upper skid beam. Each travelling member 33 has downwardly and inwardly extending flanges 57 for communicating with the associated upper skid beam through the means of roller bearing assemblies. The upper and lower skid beams, the carriage rails and travelling members comprise the means for presenting a relatively low coefficient of friction or lateral resistance between the substructure and the face of the platform.

The preferred locomotion means in this embodiment of the invention illustrated in FIGS. 10, 11 and 12, comprises a rack gear 60 mounted longitudinally along the length of each of the lower skid beams between the two carriage rails 55. The top surface (not shown) of the rack gear 60 presents a ratchet. A similar rack gear 60 is mounted longitudinally along the length of each of the upper skid beams. Each of the traveling members 33 includes a drive pinion 61 mounted between the wheels 56 on the axle 62 which support such wheels. The axle 62 extends laterally into a motor housing 63 mounted on a selected side of the travelling member 33. Secured to the motor housing 63 is a drive motor 64, such as Poclain Hydraulic Motor Model 2000, which is coupled to the axle 62 through a drive coupling 65 or some other means well known to the skilled artisan. Rotation of the drive motor 64 is a selected direction effects rotation of the axle 62 and the drive pinion 61 and wheels 56 mounted thereon, and causes the travelling member 33 to move along the rack gear 60 and the carriage rails 55.

In operation, the operator of the platform preferably selectively energizes the drive motors 64 operatively connected to the drive pinion 61 carried by the travelling members 33 mounted beneath the upper skid beams 25 and 26 to move the upper skid beams 25 and 26 along the length of the lower skid beams 15, 16, 17 and 18 until the upper skid beams 25 and 26 are positioned in a desired relationship to the aperture 11. The operator of the system then energizes the drive motor 64 operatively connected to the drive pinion 61 carried by the travelling members 33 mounted on the apexes of the substructure 13 to move the substructure longitudinally along the upper skid beams until the substructure 13 is positioned in a desired relationship to the aperture 11.

Figure 14:
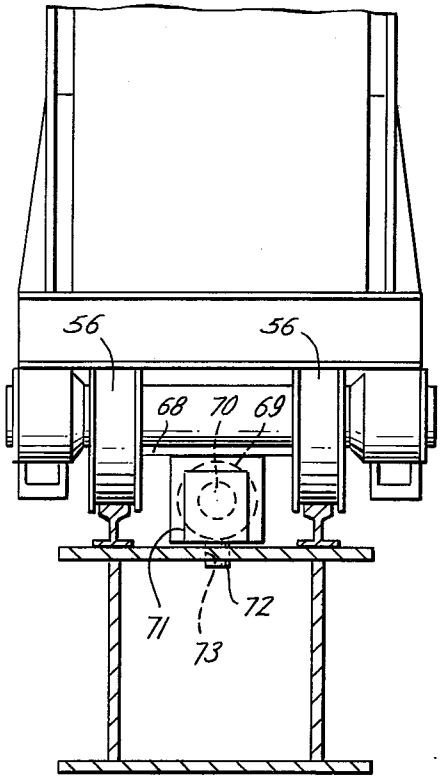
FIG. 14 is a side view of the locomotion means taken at line 14—14 in FIG. 13.
Figure 13:
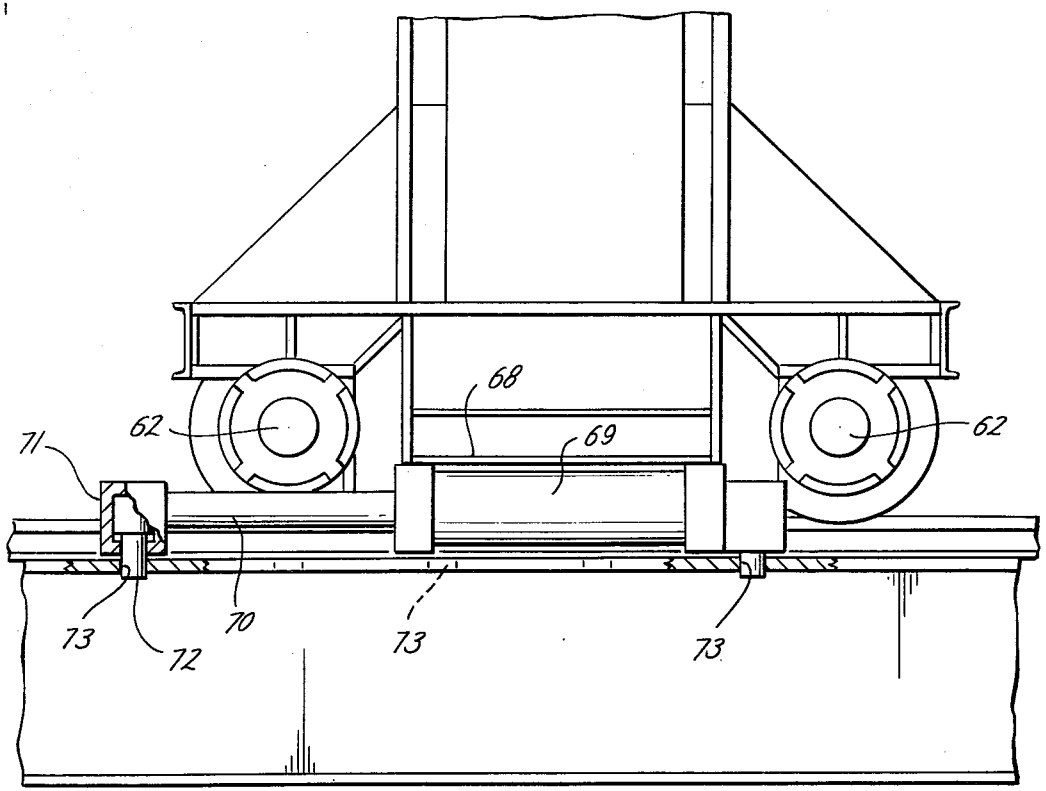
FIG. 13 is an elevational view of another embodiment of a locomotion means for use in moving the substructure laterally over the face of the platform.

FIGS. 13 and 14 illustrate an alternate locomotion means for use with the embodiment of the invention described in FIGS. 10, 11 and 12. Rather than utilizing a drive motor and drive pinion secured to the travelling members 33 and a corresponding drive gear 60, each travelling member 55 preferably includes a horizontal plate 68 mounted to the underside of the travelling member between the horizontal axles 62. Secured to the underside of the horizontal plate 68 is a hydraulic piston and cylinder assembly 69. A drive piston rod 70 is attached to the piston (not shown) and extends from the cylinder 69, between one of the set of wheels 56, and along the top of the skid beam. Secured to the end of the piston rod 70 is a jacking pin assembly 71 which preferably is a hydraulic piston and cylinder assembly which functions to extend and withdraw a downwardly extending piston rod 72. A similar jacking pin assembly is mounted to the closed end of the hydraulic cylinder 69. A series of aligned jacking pin holes 73 are formed in the upper plate of the skid beam longitudinally along its length. In operation each travelling member 33 is moved longitudinally along the surface of the supporting skid beams by the selective operation of the various jacking pin assemblies 71 and the associated driving piston and cylinder assemblies 69.

From the foregoing, it will be understood that this present invention provides an improved platform for performing subaqueous operations in ice conditions in which a substructure on the platform supports the equipment for performing the subaqueous operations and straddles an aperture through the platform. Means are secured to the underside of the substructure for presenting a relatively low lateral resistance to the movement of the substructure across the face of the platform. Locomotion means are associated with the substructure for moving the substructure horizontally over the face of the platform relative to the aperture whereby the equipment for performing the subaqueous operation may remain centered over the well hole in spite of certain magnitudes of lateral movement of the platform responsive to the ice conditions. It will be now apparent to those skilled in the art that the foregoing disclosure and description of the invention is illustrative and explanatory thereof, and various changes may be made in the construction of the improved apparatus within the scope of the appended claims without departing from the spirit of the invention.

What is claimed is:

1. An improved platform from which subaqueous operations are performed in ice conditions, the platform having an aperture therethrough through which the subaqueous operations are performed, the improvement comprising:

at least two lower skid beams secured to the face of the platform, the two lower skid beams being positioned parallel to each other on opposite sides of the aperture;

at least two upper skid beams positioned the top of the lower skid beams, the two upper skid beams being positioned parallel to each other on opposite sides of the aperture;

a substructure for supporting equipment for performing the subaqueous operations positioned atop the upper skid beams;

at least one carriage rail mounted longitudinally along selected lengths of each of said upper skid beams and said lower skid beams;

at least two travelling members carried by the underside of the substructure, each travelling member being associated with an upper skid beam, each of such travelling member including a wheel for communicating with the carriage rail mounted on such upper skid beam and presenting relatively low lateral resistance between the substructure and the upper skid beam whereby the substructure may move in either direction longitudinally along the upper skid beams;

at least two travelling members carried by the underside of the upper skid beams, each travelling member being associated with a lower skid beam, each of such travelling members including a wheel for communicating with the carriage rail mounted on such lower skid beam and presenting relatively low lateral resistance to the movement of the upper skid beam relative to the lower skid beam whereby the upper skid beams may move in either direction longitudinally along the lower skid beams;

a gear rack mounted longitudinally along selected lengths of each of said upper and lower skid beams;

a drive pinion carried by each of the travelling members and in communication with gear rack mounted on the respective skid beam with which the travelling member is associated;

a drive motor associated with each travelling member and operatively coupled to the drive pinion for generating motive forces to revolve the drive pinion whereby the substructure may be moved in either direction longitudinally along the upper skid beam and the upper skid beams may be moved in either direction longitudinally along the lower skid beams.

2. In an improved platform from which subaqueous operations are performed in ice conditions, the platform having an aperture therethrough through which the subaqueous operations are performed and having a substructure carried by the platform for supporting the equipment for performing subaqueous operations, said substructure being positioned such that it straddles the aperture and said substructure preferably remaining in a fixed lateral position with respect to the subaqueous operations being performed by the equipment supported by such substructure, an improved apparatus associated with the underside of the substructure for presenting relatively low lateral resistance to the movement of the platform horizontally beneath the fixed position substructure comprising:

at least two first guide means carried by the platform in parallel relationship with each other, one of such first guide means being on each side of the aperture;

at least two second guide means positioned in parallel relationship with each other, one of such second guide means being on either side of the aperture, said second guide means being positioned above the first guide means;

at least two first wheeled traveling members secured to the underside of each of the second guide means, each of such first wheeled traveling members being positioned such that it is in contact with one of the first guide means and may move longitudinally along such first guide means;

a drive motor associated with at least one of such first wheel traveling members and operatively coupled to the wheel portion thereof for generating motive forces to revolve such wheel in a selected direction;

at least four second wheeled traveling members secured to the underside of the substructure, such second wheel traveling members being positioned such that at least two of such second wheeled traveling members are in contact with the upper surface of each of the second guide means and may move longitudinally along such second guide means;

a drive motor associated with at least one of such second wheeled traveling members and operatively coupled to the wheel portion thereof for generating motive forces to revolve such wheel in a selected direction;

the controlled operation of the drive motors and the associated wheeled traveling members providing relatively low lateral resistance to the movement of the platform as it moves horizontally underneath the positioned substructure responsive to the ice conditions.

3. In a platform from which subaqueous operations are performed in ice conditions, the platform having an aperture therethrough through which the subaqueous operations are performed and the platform carrying a substructure for supporting the equipment for performing the subaqueous operations, such substructure being positioned whereby it straddles the aperture and said substructure preferably remaining in a fixed lateral position with respect to the subaqueous operations being performed by the equipment supported by such substructure, the improved method of allowing the platform to move horizontally beneath the fixed position substructure responsive to the ice forces whereby the platform may move relative to the substructure and the substructure may remain in a fixed lateral position above the subaqueous operations being performed by the equipment carried by the substructure, including the steps of:

positioning between the underside of the substructure and the platform: at least two first guide means in parallel relationship, one of such first guide means being positioned on either side of the aperture; at least two second guide means in parallel relationship with each other, one of such second guide means being positioned on either side of the aperture, said second guide means being positioned above the first guide means, first wheeled traveling members secured beneath each of the second guide means and in contact with one of the first guide means for longitudinal movement therealong; second wheeled traveling members secured beneath the underside of the substructure and in contact with the second guide members for longitudinal movement therealong; drive motors associated with the wheel traveling members and operatively coupled thereto for generating motor forces to revolve the wheeled portion thereof; and operating the drive motors whereby the traveling members move selected distances longitudinally along the first and second guide means and the platform is moved horizontally beneath the substructure responsive to ice conditions to maintain the substructure in a fixed position.

* * * * *